US008226779B2

(12) United States Patent
Imagawa et al.

(10) Patent No.: US 8,226,779 B2
(45) **Date of Patent: *Jul. 24, 2012**

(54) COMPACTED MAGNETIC CORE, PRODUCTION METHOD OF THE SAME, AND MOTOR FOR ELECTRIC VEHICLE

(75) Inventors: Takao Imagawa, Mito (JP); Yuichi Satsu, Hitachi (JP); Matahiro Komuro, Hitachi (JP); Hiroyuki Suzuki, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 375 days.

This patent is subject to a terminal disclaimer.

(21) Appl. No.: 12/099,800

(22) Filed: Apr. 9, 2008

(65) Prior Publication Data

US 2008/0260564 A1 Oct. 23, 2008

(30) Foreign Application Priority Data

Apr. 10, 2007 (JP) ..... 2007-102314

(51) Int. Cl.
*H01F 1/24* (2006.01)

(52) U.S. Cl. ..... 148/104; 148/105

(58) Field of Classification Search ..... None
See application file for complete search history.

(56) References Cited

U.S. PATENT DOCUMENTS

| | | | | |
|---|---|---|---|---|
| 7,816,820 | B2 * | 10/2010 | Imagawa et al. | 310/44 |
| 2008/0008897 | A1 | 1/2008 | Imagawa et al. | |

FOREIGN PATENT DOCUMENTS

| | | |
|---|---|---|
| JP | 07-254522 | 10/1995 |
| JP | 2006-041203 | 2/2006 |
| JP | 2006-097124 | 4/2006 |
| JP | 2006-173430 | 6/2006 |
| JP | 2006-283042 | 10/2006 |
| JP | 2008-016670 | 1/2008 |

OTHER PUBLICATIONS

Machine Translation of Japanese Patent Document 2006-041203.*
U.S. Appl. No. 11/924,779, filed Oct. 26, 2007, Imagawa et al.

* cited by examiner

*Primary Examiner* — John Sheehan
(74) *Attorney, Agent, or Firm* — Antonelli, Terry, Stout & Kraus, LLP.

(57) ABSTRACT

A manufacturing method of a magnetic core includes a first step of applying a treatment liquid for forming an insulating film to iron powder; a second step of heat-treating the iron powder to which the treatment liquid has been applied, at a temperature higher than 350 degrees; a third step of compacting the heat-treated iron powder to form a magnetic core; and a forth step of heat-treating the magnetic core at a temperature ranging from 600 degrees to 800 degrees.

8 Claims, 3 Drawing Sheets

FIG. 1 CONVENTIONAL METHOD
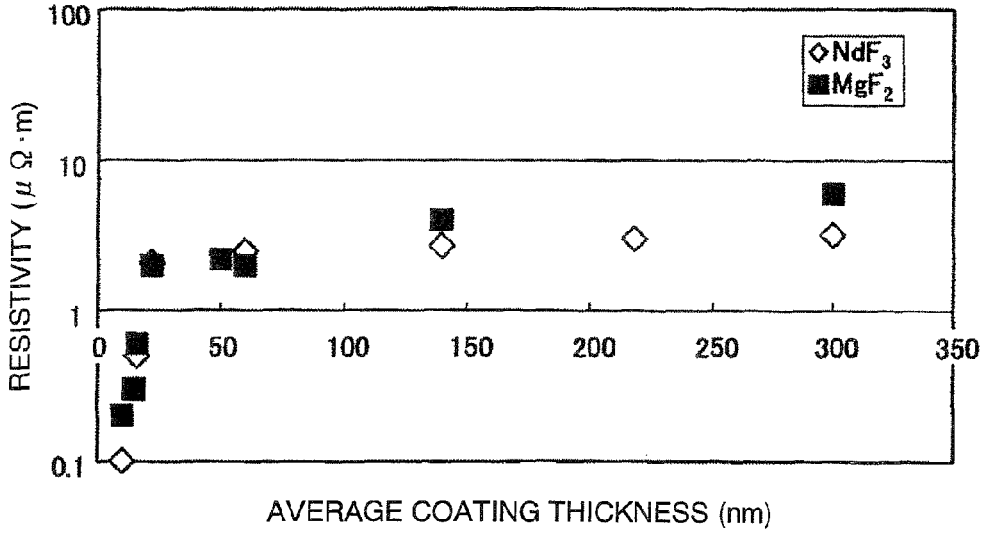
FIG. 2 CONVENTIONAL METHOD
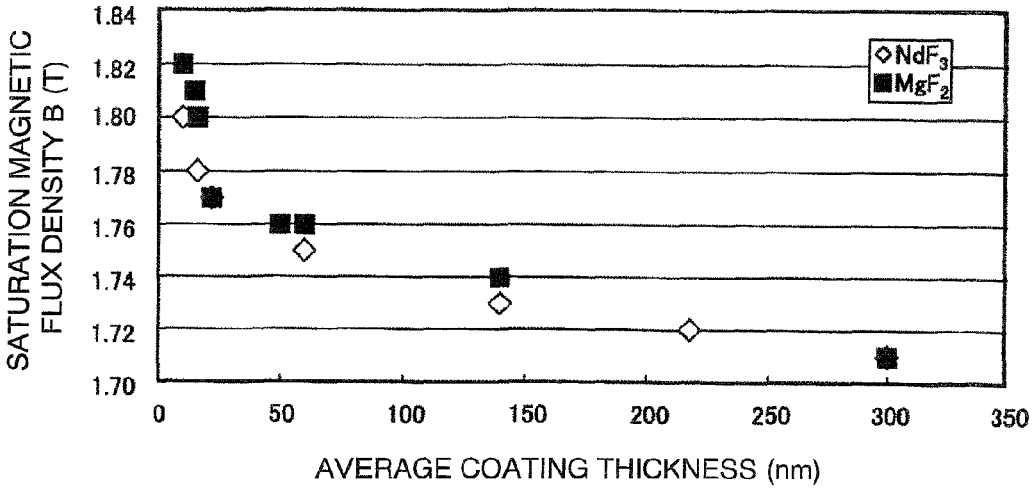

COMPACTED MAGNETIC CORE, PRODUCTION METHOD OF THE SAME, AND MOTOR FOR ELECTRIC VEHICLE

CLAIM OF PRIORITY

The present application claims priority from Japanese application serial No. 2007-102314, filed on Apr. 10, 2007, the content of which is hereby incorporated by reference into this application.

FIELD OF THE INVENTION

The present invention relates to compacted magnetic cores produced by compacting magnetic powder that includes an iron element, and in particular, relates to compacted magnetic cores for electrical components such as a rotating electrical machine or a reactor.

BACKGROUND OF THE INVENTION

Recently electric vehicles have been receiving much attention from environmental perspectives. Such electric vehicles are provided with rotating electrical machines (motors) as a source of power and a smoothing transformer (reactor) in the inverter circuit. Consequently, those components are expected to have improved efficiency. For this reason, a magnetic core for the rotating electrical machine or smoothing transformer are required to have high resistivity and magnetic flux density.

The following patent documents 1 to 3 disclose technologies to achieve higher resistance in a magnetic core.

Japanese Patent Laid-open No. 2006-41203 and Japanese Patent Laid-open No. 2006-283042 disclose a compacted magnetic core with high resistance achieved by coating a surface of iron powder particles with a fluoride insulating film. In addition, Japanese Patent Laid-open No. 2006-97124 discloses a magnetic core with high resistance achieved by applying magnesium on surfaces of iron powder particles and heat-treating them to form MgO films.

SUMMARY OF THE INVENTION

A magnetic core for a rotating electrical machine or a smoothing transformer is definitely required to have low iron loss and high magnetic flux density, but it is also expected that those magnetic properties of the core are not deteriorating in low-frequency and high-frequency regions.

The iron loss includes eddy-current loss, which is strongly related to resistivity of the magnetic core, and hysteresis loss, which is affected by an internal stress of iron powder generated by the production process of the iron powder and its subsequent processes. Iron loss (W) can be expressed as a sum of eddy-current loss (We) and hysteresis loss (Wh) as shown in Equation 1 below. In the equation, f is frequency, Bm is excitation magnetic flux density, ρ is resistivity, t is thickness of material, and $k_1$ and $k_2$ are coefficients.

$$W=We+Wh=(k_1Bm^2t^2/\rho)f^2+k_2Bm^{1.6}f \quad \text{(Equation 1)}$$

As shown in Equation 1, since eddy-current loss (We) increases proportionally to the square of frequency f, it is necessary to suppress the eddy-current loss (We) in order to prevent the magnetic property from deteriorating especially in high frequency. To suppress eddy current from being generated in a compacted magnetic core, it is necessary to optimize the size of magnetic powder particles to be used, to form an insulating film on a surface of each magnetic powder particle, and to compact the magnetic powder particles to form the compacted magnetic core.

In such a compacted magnetic core, if the insulation is not enough, the resistivity p will be reduced, thus increasing the eddy-current loss (We). On the other hand, if the insulating film is made thicker to increase the insulation, the ratio of the content of soft magnetic powder in the magnetic core will be lower, thus reducing the magnetic flux density B. Furthermore, for the purpose of improving the magnetic flux density, if the soft magnetic powder is compacted at high pressure to increase its density, an internal stress of the soft-magnetic powder during the compaction is inevitable. Thus, the hysteresis loss (Wh) will increase, and as a result, it will be difficult to suppress the iron loss (W). In particular, since the eddy-current loss (We) will be small in a low-frequency region, an effect of the hysteresis loss (Wh) within the iron loss (W) will be significant.

Coercive force of a compact, which causes hysteresis loss, can be reduced by heat-treating the compact at high temperature (stress relieving heat treatment), and as a result, the hysteresis loss can be reduced. Unfortunately, no insulating film can withstand such a high-temperature heat treatment, so that the temperature of the heat treatment must be limited in order to suppress eddy-current loss. For this reason, a low-loss magnetic core has not been achieved.

In the above-mentioned Japanese Patent Laid-open No. 2006-41203 and Japanese Patent Laid-open No. 2006-283042, since the fluoride insulating film material alone has high resistance at high temperature, it is considered desirable as an insulating film for compacting powder. To apply the magnetic core to various types of motor yokes, however, the resistivity of 20 μΩ·m or more is required. In order to reduce hysteresis loss, a compacted magnetic core motor yoke should be heat treated for relieving stress at 600° C. after compaction. A study had been carried out using a typical fluoride, $NdF_3$, for coating water-atomized powder, but the resistance value was not enough even when the thickness of the $NdF_3$ film had been increased.

In addition, the method of the above-mentioned Japanese Patent Laid-open No. 2006-97124 lacks in practicality because it is not only troublesome, requiring a prior oxidation treatment of iron powder, but also difficult to uniformly apply Mg powder on a surface of the iron powder particles. Furthermore, heat resistance of the MgO film is limited to 600° C. maximum.

The present invention clarifies the requirements for making necessary coating layers, and provides soft magnetic powder for the magnetic core which can be used in high frequency or which can be applied to large rotating machines. An object of the present invention is to achieve a compacted magnetic core with improved resistivity and magnetic flux density compared to conventional cores.

In an initial study, the coating production method of patent document 2 was used. An experiment was conducted accordingly in which the improved iron powder particles, the shape of which is reformed, were used as raw powder, and they were coated with $NdF_3$, compacted and heat-treated. As a result, although the resistance value was high enough, the B tuned out to be too low to sufficiently operate a rotating machine.

The iron powder particles were therefore pre-heat-treated, immediately after being coated with $NdF_3$, at the temperature of the stress relieving heat treatment, and after being compacted, heat-treated for stress relief. In this way, the resistance value was increased, allowing the $NdF_3$ film to be made thin. However, the B of the compact obtained by this method was only about 1.7 T, requiring a further improvement in the value of B.

A characteristic of the compacted magnetic core according to the present invention is that it uses alkaline earth metal fluoride, or particularly $MgF_2$, as coating material in the above process. The $MgF_2$-coated iron powder was controlled with regard to the powder shape, pre-heat-treated before being compacted, at a temperature same as that of the subsequent stress relieving heat treatment or as low as 100° C., and then compacted to produce the compacted magnetic core.

Specifically, to solve the above problems, the production method of a magnetic core according to the present invention includes a first step of applying a treatment liquid for forming a insulating film to iron powder, a second step of heat-treating the iron powder to which the treatment liquid has been applied, at a temperature higher than 350 degrees, a third step of compacting the heat-treated iron powder to form a magnetic core, and a forth step of heat-treating the magnetic core at a temperature ranging from 600 degrees to 800 degrees. In this production method, the iron powder may be any one of gas-atomized powder, reduced powder, or water-atomized powder. Also in this production method, the insulating film may be composed of alkaline earth metal fluoride, or particularly $MgF_2$, and a thickness of the film may be from 20 nm to 300 nm, or specifically from 50 nm to 150 nm. The heat treatment in the second step of this production method may be performed at a temperature ranging from 500 degrees to 600 degrees.

In addition, the magnetic powder in the present invention is characterized by an average thickness of the $MgF_2$ coating being from 20 to 300 nm. This production method is suitable for obtaining the above-mentioned compacted magnetic core.

According to the present invention, a high-density compact with high heat-resistance and resistivity, magnetic powder for obtaining the compact, and preferable treatment conditions for producing the magnetic powder can be obtained.

BRIEF DESCRIPTION OF THE DRAWINGS

FIG. 1 shows the average coating thickness/resistivity of the $MgF_2$-coated iron powder and $NdF_3$-coated iron powder formed according to a conventional method.

FIG. 2 shows the average coating thickness/saturation magnetic flux density of the $MgF_2$-coated iron powder and $NdF_3$-coated iron powder formed according to a conventional method.

DESCRIPTION OF THE PREFERRED EMBODIMENTS

Figure 3:
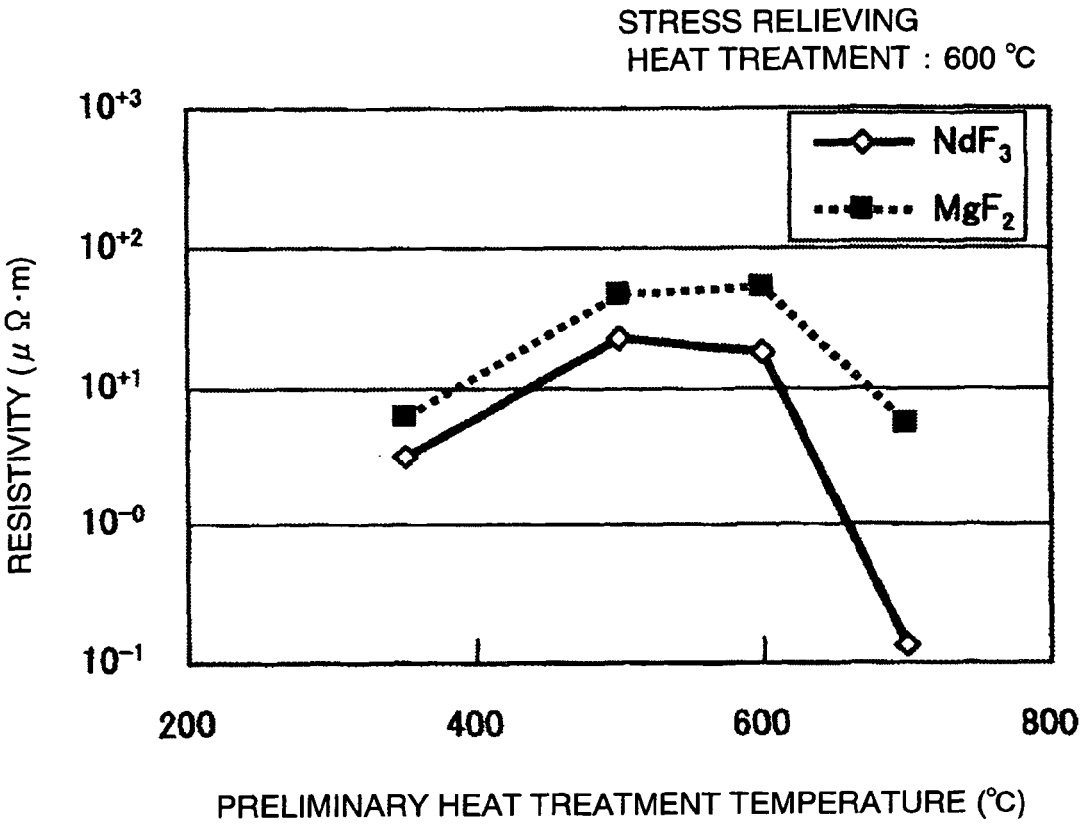
FIG. 3 shows a performance improvement of the $MgF_2$ and $NdF_3$ coatings achieved by the preliminary heat treatment which relates to the present invention.

Compacted magnetic cores which relate to the present invention, and their compositions are described below.

FIG. 1 shows a characteristic of the compacted magnetic cores produced by adapting the coating method according to patent document 1. In each of these compacted magnetic cores, a surface of iron powder particles is covered by a fluoride insulating film. In FIG. 1, the horizontal axis represents the average coating thickness (nm) of the fluoride insulating films, and the vertical axis represents resistivity (μΩ·m) of the compacted magnetic cores. Each of $NdF_3$ and $MgF_2$ is used as an insulating film and all results are plotted in the chart.

In this experiment, water-atomized iron powder was applied with each of $NdF_3$ and $MgF_2$ coating materials in various coating thicknesses, and after being compacted, they were heat-treated for stress relief at 600° C. In each case, the heat treatment was performed for 30 minutes. The coating method in patent document 2 was followed. The solvent-removal heat treatment was carried out at 350° C. The amount of the treatment liquid used was based on a ratio of 1 g of hydrated raw salt to 20 g of iron powder, and the film thickness was adjusted by diluting the treatment liquid with alcohol for a thinner film or by applying multiple coatings for a thicker film. After the powder was compacted, its film thickness was measured by means of cross-sectional SEM observation. Each resistance value shown in the chart was taken after the powder was compacted at a pressure of 1.5 GPa and heat-treated for stress relief at 600° C.

The result, as shown in FIG. 1, illustrates that $MgF_2$ coatings had a slightly higher resistivity than $NdF_3$ coatings when their average coating thicknesses were 150 nm or more, however, none of them could have achieved the value of 20 μΩ·m required.

FIG. 2 shows about the samples created under the same condition as FIG. 1, in which the horizontal axis represents the average coating thickness (nm) and the vertical axis represents saturation magnetic flux density B (T) of the compacted magnetic cores. The result illustrates that the value of B is determined depending on the coating thickness regardless of the type of the coating materials, i.e., $NdF_3$ or $MgF_2$.

The conventional method described above has been improved in the method according to the present invention which is illustrated below.

In the present invention, the coating material for forming a fluoride insulating film is applied to iron powder particles, the shape of which is designed to avoid coating breakage caused by protrusions of the iron powder particles, the breakage is considered to be one of the reasons for the above-mentioned low resistivity. After the application of the coating material, a preliminary heat treatment is carried out. Explaining in more detail, basically spherical-shaped gas-atomized iron powder particles having an average particle diameter of 100 μm are coated with $NdF_3$ and $MgF_2$ in a thickness of 150 nm, compacted after the preliminary heat treatment, and heat-treated for stress relief at 600° C.

A property of the compacted magnetic cores formed by this technique is shown in FIG. 3. In FIG. 3, the horizontal axis represents a temperature (° C.) of the preliminary heat treatment (heat treatment carried out before compaction and after application of coating material) and the vertical axis represents resistivity (μΩ·m) of the compacted magnetic cores. The result has indicated that resistivities of the $NdF_3$ core and $MgF_2$ core were both below 10 μΩ·m when the heat treatment for coating-solvent removal was performed at 350° C., however, when the preliminary heat treatment was performed at a temperature from 500° C. to 600° C., the resistivities of both the $NdF_3$ core and $MgF_2$ core had increased over 20 μΩ·m, thus improving their property.

Furthermore, it became clear that the $MgF_2$ core had a better property than the $NdF_3$ core maintaining a certain level of resistivity even when the temperature of the preliminary heat treatment had been raised to 700° C., indicating that it had better heat resistance.

In order to verify this effect, gas-atomized powder particles with an average particle diameter of 100 μm were coated with $NdF_3$ and $MgF_2$ in various coating thicknesses. After the preliminary heat treatment at 600° C., they were compacted at a compacting pressure of 1 GPa, then heat-treated for stress relief at 600° C. The result is shown in FIG. 4.

Figure 4:
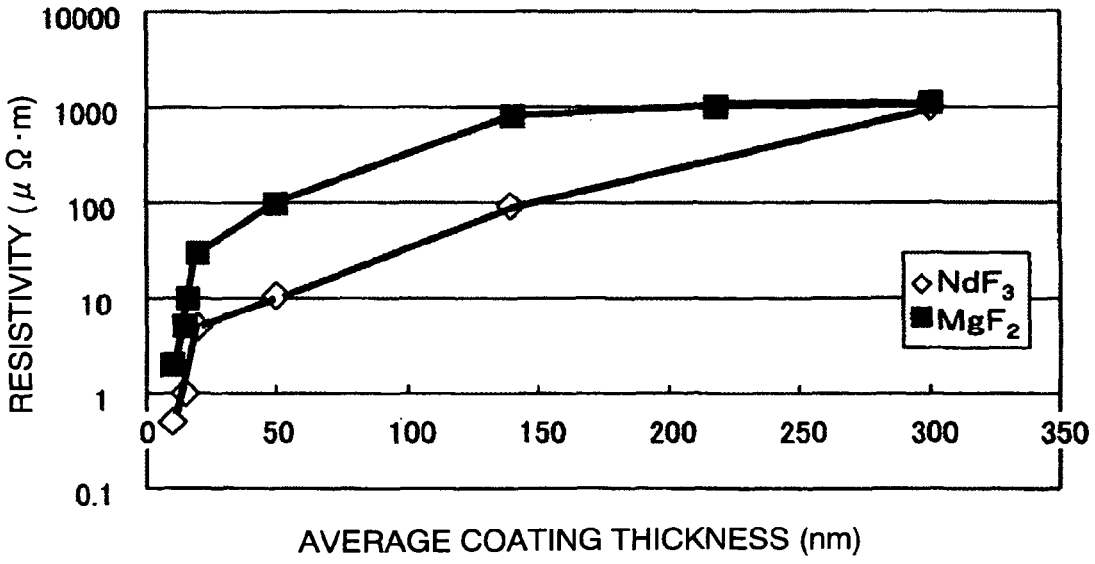
FIG. 4 shows the average coating thickness/resistivity of the $MgF_2$-coated iron powder and $NdF_3$-coated iron powder formed according to the present invention.

In FIG. 4, the horizontal axis represents the average coating thickness (nm) of the fluoride insulating films, and the vertical axis represents resistivity (μΩ·m) of the compacted magnetic cores. It is clear that although the $NdF_3$ core achieves high resistivity of 1000 μΩ·m at the coating thickness of 300 nm, its resistivity significantly decreases as the coating thickness becomes thinner, falling below 20 μΩ·m at 100 nm. On the other hand, the $MgF_2$ core has less dependency on the film thickness. Its resistivity does not start decreasing until below 100 nm, and the $MgF_2$ core maintains the required value of 20 μΩ·m even at 20 nm. In other words, if $MgF_2$ is used as a fluoride insulator, the insulating film can be made thinner while still maintaining high resistivity compared to $NdF_3$. This means that, also from the property shown in FIG. 2, high resistivity and magnetic flux density can be achieved by adjusting film thickness.

A reason for the resistivity difference between these different types of fluoride compounds used is not clear, but since some cracking textural changes in the $NdF_3$ coating especially in thick regions are observed by SEM observation, it is possible to think that some mechanical constants such as hardness and viscosity of the fluoride are associated with the difference.

Such difference in film-thickness dependency can also be seen in $LaF_3$ and $CaF_2$ cases, which leads to an assumption that there exists a difference between rare-earth compounds and others. Compared with some fluorides other than $NdF_3$, which had been compared in FIG. 4, $MgF_2$ have had a particularly better property than others, and thus, it was employed as an insulating film in the present invention. In addition, a thickness of the insulating film was set from 20 nm to 300 nm. A further optimal range of the film thickness was set from 50 nm to 150 nm for obtaining both high resistivity and high magnetic flux density.

Steps for producing the compacted magnetic cores according to the present invention are described below.

(Preparation of a Treatment Liquid)

Basically, patent document 2 was followed. As raw material salt to be used, $Nd(CH_3COO)_3.H_2O$ was used for $NdF_3$ and $Mg(CH_3COO)_2.4H_2O$ was used for $MgF_2$.

(Forming Samples)

(1) To 40 g of raw material iron powder, 8 mL of $NdF_3$ or $MgF_2$ treatment liquid was prepared. This corresponds to a coating of 140 nm thickness for particles with a diameter of 100 μm. As for the film thickness, a thin film was created by increasing the amount of iron powder, and a thick film was created by applying the treatment liquid multiple times.

(2) The treatment liquid was added and mixed until the entire iron powder was wet.

(3) Methanol solvent was removed at a reduced pressure of 2 to 5 torr from the treated iron powder of Step (1).

(4) The iron powder from which the solvent had been removed in Step (3) was placed in a quartz boat and heat-treated at a reduced pressured of $5\times10^{-5}$ torr at 200° C. for 30 minutes and at 350° C. for 30 minutes to make raw material iron powder.

(5) Furthermore, the treated iron powder was pre-heat-treated at a reduced pressure at 600° C. for 30 minutes.

(6) The iron powder which had been heat-treated in Step (5) was, using a superhard mold, compacted into a ring sample having an outer diameter of 25 mm and an inner diameter of 15 mm. The compaction pressure was 33 t. This sample was for measuring magnetic flux density and coercive force.

(7) The iron powder formed in Step (5) was compacted into a rectangular sample using a 10×10 mm mold. The compaction pressure was 15 or 10 t. This sample was for measuring resistivity. Such a pressure difference would not affect density of the sample.

(8) The samples formed in Steps (6) and (7) were heat-treated at a reduced pressure of $5\times10^{-5}$ torr at 600° C. The density of the samples were both 95% or above.

(9) Four-terminal method was used for resistivity measurement. The ring sample was provided with a primary winding of 150 turns and a secondary winding of 20 turns, and the loss W was determined from the saturation magnetic flux density B at DC excited magnetic field of 10,000 A/m and from the hysteresis loop of when it was excited at 400 Hz until B reaches 1 T.

Figure 5:
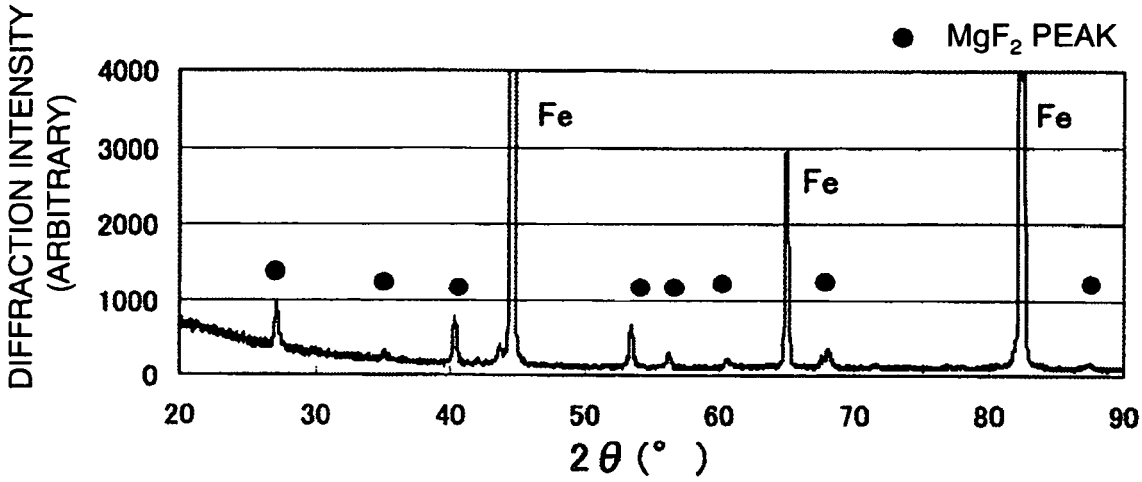
FIG. 5 shows a result of X-ray structural analysis of the $MgF_2$-coated iron powder formed according to the present invention.

FIG. 5 shows an X-ray diffraction pattern of the treated iron powder after the preliminary heat treatment of (5) in the above process. In FIG. 5, although multiple Fe peaks and $MgF_2$ peaks are observed, no other major peaks are found, which makes it clear that the treated iron powder includes only $MgF_2$ and Fe base. As a result, it was confirmed that the $MgF_2$ film has been formed basically free of defect.

In the present invention, the film may be formed with $MgF_2$ alone or in multiple layers with other fluorides such as $NdF_3$ and/or oxides such as $SiO_2$ or MgO.

Specific embodiments according to the present invention are described below. In each embodiment, the above-mentioned production method was followed.

[Embodiment 1]

Gas-atomized iron powder particles with a particle diameter of 100 μm were used.

This iron powder was coated with a 30-nm $MgF_2$ coating, and its resistivity and ring measurements were taken.

The resistivity was 50 μΩ·M. From the ring measurement, the saturation magnetic flux density B was 1.76 T, and the loss was 37 W/kg. For the $NdF_3$ coating with the same film thickness, the loss turned out to be 80 W/kg.

[Embodiment 2]

Water-atomized iron powder particles with an average particle diameter of 70 μm were used as soft magnetic powder, and a ball-mill treatment was carried out with SUS balls. Protrusions had been removed from the iron powder particles after 30 minutes of treatment.

This iron powder was coated with a 50-nm $MgF_2$ coating, and its resistivity and ring measurements were taken.

The resistivity was 70 ~Ω·m. From the ring measurement, the saturation magnetic flux density B was 1.75 T, and the loss was 45 W.

[Embodiment 3]

Reduced iron powder particles with an average particle diameter of 120 μm were used.

This iron powder was coated with a 100-nm $MgF_2$ coating, and its resistivity and ring measurements were taken.

The resistivity was 250 μΩ·m. From the ring measurement, the saturation magnetic flux density B was 1.7 T, and the loss was 47 W/kg.

[Embodiment 4]

Water-atomized iron powder particles with an average particle diameter of 70 μm were used as soft magnetic powder, and a ball-mill treatment was carried out with SUS balls for 30 minutes.

This iron powder was coated with a 40-nm $MgF_2$ coating, and after the preliminary heat treatment at 600° C., it was formed into a stator core for a 4-pole, 6-slot rotating machine. Then the core was heat-treated for stress relief at 600° C., and after its surface was molded with resin, it was wound and built into a motor together with a stator.

For comparison, another motor was built in the same matter with a magnetic core in which the fluoride insulating film of the above composition was replaced with a 70-nm $NdF_3$ coating.

The result indicated that while the resistivity of the $MgF_2$ coating was 30 μΩ·m, the $NdF_3$ coating had the equal value of resistivity because its film thickness had been increased.

On the other hand, it became clear that while the saturation residual magnetic flux density B for the $MgF_2$ was 1.75 T, that of the $NdF_3$ had dropped to 1.65 T because of the increased insulating film thickness. It was also learned that, while keeping the heat generation to the same level, the $MgF_2$ was able to increase its power output by 10% compared to the $NdF_3$.

In this way, the compacted magnetic core according to the present invention can be used as a core part having small hysteresis loss or eddy-current loss as well as an iron core for a motor that requires high magnetic density, a solenoid core (stator core) for an electromagnetic valve which is built into an electronically-controlled fuel injector for a diesel engine and a gasoline engine, and a core part for a plunger and other various actuators.

What is claimed is:

1. A manufacturing method, for manufacturing a magnetic core, comprising:

a first step of applying a treatment liquid to form an insulating film, including $MgF_2$, on iron powder particles;

a second step of pre-heat-treating the iron powder particles to which the treatment liquid has been applied, at a temperature ranging from 500 to 700 degrees centigrade;

a third step of compacting the pre-heat-treated iron powder particles to form a magnetic core; and a fourth step of stress relieving heat-treating the magnetic core, at a temperature ranging from 600 to 800 degrees centigrade, inclusive.

2. The manufacturing method according to claim 1, wherein the iron powder is any one of gas-atomized powder, reduced powder, or water-atomized powder.

3. The manufacturing method according to claim 1, wherein the insulating film has a thickness selected from a range that spans from 20 nm to 300 nm, inclusive.

4. The manufacturing method according to claim 1, wherein the insulating film has a thickness selected from a range that spans from 50 nm to 150 nm, inclusive, and has a resistivity of at least 20 μΩ·m and at most 1000 μΩ·m.

5. The manufacturing method according to claim 1, wherein the second step of pre-heat-treating is carried out at a temperature ranging from 500 degrees to 600 degrees centigrade.

6. The manufacturing method according to claim 1, wherein after the second step of pre-heat-treating the iron powder particles, the pre-heat-treated iron powder particles are basically free of impurities.

7. The manufacturing method according to claim 1, wherein the second step of pre-heat-treating is carried out at a temperature within a range with an upper bound, inclusive, of the temperature at which the fourth step of stress relieving heat-treating is carried out, and a lower bound, inclusive, of 100 degrees centigrade below said temperature at which the fourth step of stress relieving heat-treating is carried out.

8. The manufacturing method according to claim 7, wherein the second step of pre-heat-treating is carried out at a temperature within a range of 500 to 600 degrees centigrade, inclusive, and the fourth step of stress relieving heat-treating is carried out at a temperature of 600 degrees centigrade.

* * * * *